United States Patent [19]

Biotteau

[11] Patent Number: 4,608,287

[45] Date of Patent: Aug. 26, 1986

[54] CONFORMABLE COVERING WITH HIGH COEFFICIENT OF FRICTION

[75] Inventor: Gérard Biotteau, Saint Pierre Montlimart, France

[73] Assignee: S.A.R.L. Manufacture Francaise des Chaussures Eram, Saint pierre Montlimart, France

[21] Appl. No.: 501,906

[22] Filed: Jun. 7, 1983

[30] Foreign Application Priority Data

Jun. 15, 1982 [FR] France ..... 82 10464

[51] Int. Cl.[4] ..... A61F 13/02

[52] U.S. Cl. ..... 428/40; 428/147; 428/215; 428/246; 428/327; 428/337; 428/354; 156/244.11

[58] Field of Search ..... 428/147, 337, 246, 215, 428/354, 327, 40, 17; 156/244.11

[56] References Cited

U.S. PATENT DOCUMENTS 2,706,936 4/1955 Willson, Jr. .
3,801,421 4/1974 Allen et al. ..... 428/17
4,196,243 4/1980 Sachs et al. ..... 428/147
4,239,797 12/1980 Sachs .

FOREIGN PATENT DOCUMENTS 2735669 2/1979 Fed. Rep. of Germany .
2112087 6/1972 France .
2439084 12/1981 France .
1231005 5/1971 United Kingdom .

*Primary Examiner*—Edith Buffalow
*Attorney, Agent, or Firm*—Young & Thompson

[57] ABSTRACT

A conformable sheet covering with high coefficient of friction, comprising a superficial layer made of a fine powder at least partially imbedded in a curable resin layer bonded to a lower support layer. The support layer is made of a thin sheet material having an elongation coefficient between 20 and 60% for a tensile force per linear centimeter less than 20N. There is a contact adhesive layer, protected by a pull off film, on the back side of the support layer. The new sheet covering is usable on three-dimensional surfaces.

6 Claims, No Drawings

CONFORMABLE COVERING WITH HIGH COEFFICIENT OF FRICTION

Floor coverings, notably for sports grounds, have already been proposed in many patents, with a superficial layer provided from a fine powder of natural or synthetic rubber partially imbedded in a resin layer applied in turn on one or several support layers. Said support layers can be very different and what is required is generally a resilient compressible layer which is typically a needled nonwoven felt.

The thickness of such coverings is relatively large, due if at all to the thickness of the corresponding support layer which is generally more than 3 millimeters thick in order to provide a substantial resilience, as disclosed in French Pat. No. 2 112 087.

Said floorings in the form of prefabricated sheets are not suitable for many applications where the covering has to be as natural as possible with respect to elasticity, be of reduced thickness and have a mechanically stable shape. In order to meet these requirements, the Applicant has already proposed in French Pat. No. 2 439 084 to apply the layer of curable resin and fine powder, usually a resin and a fine powder of polyurethane, on a calendered nonwoven support layer. In the calendered nonwoven layer, the fibers are heat fused, the thickness and resilience are greatly reduced, the thickness being between 0.1 and 1 millimeter, and the shape stability is excellent. However, in some applications, this shape stability is a disadvantage since the flooring, due to the shape stability of the support layer, does not adapt to non planar surfaces nor to applications such as the covering of portions of boat decks having a warped surface, the covering of various handles and hand-holds on which is provided an overlapping helical wrapping of a relatively narrow band, etc. A sheet material on a calendered nonwoven layer of 0.3 mm such as that disclosed in French Pat. No. 2 439 084 exhibits a deformation of 3 to 15% under a force of 50 to 60N applied to a band one centimeter wide. In fact, the elongation which is obtainable at the moment of the application is extremely small and even practically nil.

The object of the present invention is to solve this problem and to provide a sheet covering of the type comprising a superficial layer formed of a fine powder at least partially imbedded in a curable resin layer, of reduced thickness and conformable to a three-dimensional surface.

According to the invention, there is used as support layer a thin sheet material having an elongation coefficient between 20 and 60% for a tensile force per linear centimeter less than 20N.

The thin layer material forming the support layer can be a plastic material film formed by extrusion or calendering, with a thickness between 0.01 and 1 mm, preferably between 0.05 and 0.10 mm, an extensible knitted type deformable textile material having a thickness less than 3 mm or a needled or chemically bonded nonwoven layer having a thickness less than 1 millimeter and an elongation before breaking between 20 and 60%.

The plastic material film can be a plastified polyvinyl chloride, a polyester or a cellulose acetate based material. The extensible knitted fabric can be made of synthetic or man-made fibers. The deformable nonwoven layer is provided for example from a mixture of cotton and superpolyamide fibers chemically bonded by an acrylic binder.

The elongation and tensile force limit values have been determined by keeping in mind that the tensile force which can be applied to the band during the laying operation is limited to a manual force, that an elongation less than 20% is not sufficient for providing the necessary conformability and that an elongation higher than 60% is likely to cause a tearing of the superficial resin and fine powder layer which has an elongation before breaking of the order of 50 to 60%.

According to a further feature which is a significant technical improvement when such a material is subjected while being laid to a tensile force which is substantially parallel to the laying surface, the back face of the support layer is coated with a contact adhesive, preferably an adhesive adhering by simple pressure. This allows bonding the covering layer onto a three-dimensional surface along a line, and then to apply it on either side of said line by exerting the required tensile force on the side edges for providing the elongation corresponding to the curves of the surface. In known manner, the adhesive layer is protected by a pull off film such as a paper sheet having a low adhesive strength for the adhesive.

Consequently, the product according to the invention includes an upper layer of cured resin, notably a polyurethane in which is at least partially imbedded a fine powder of a compatible material, notably polyurethane, with a granulometry between 0.2 and 1 mm, the overall thickness of the layer being between 0.5 and 3 mm, a support layer formed of a thin sheet material having an elongation coefficient between 20 and 60% for a tensile force per linear centimeter less than 20N and bonded to the hereabove layer by chemical welding during the curing of the compatible materials and/or by partial imbedding of the fibers constituting of said thin sheet material and a contact adhesive layer protected by a pull off film on the back face of the support layer, and the overall thickness of the covering being between 0.5 and 3 mm.

According to a further feature, a layer of curable resin is applied on the upper layer in order to coat the fine powder.

The covering obtained exhibits a high coefficient of friction imparting to it an anti-skid property, and is thermally insulating even for a small thickness, which makes it particularly appropriate for an application on handles and hand-holds such as fishing rod handles, tennis racket handles, ski stick handles, bicycle handlebars and steering wheels, tool handles and weapon grips, its elongation capacity making it adaptable for an application as a helical wrapping of a band, with overlapping turn. It also forms a covering material particularly adapted to curved or plane surfaces such as the upper surfaces of wind surfs, boat decks, stair steps, shop display stands, automobile instrument boards and window shelves, various wall linings, etc.

Further features will become more apparent from the hereafter detailed description of two embodiments.

EXAMPLE 1

As support layer has been used a plastified polyvinyl chloride film 0.05 mm thick, having a tensile strength of 10N per linear cm and an elongation before breaking of 60%. This film was coated on one face with an acrylic resin based adhesive adhering by simple pressure and protected by a paper sheet.

On the second face of the polyvinyl chloride film was applied an adherence primary agent, and then was deposited by casting with a die on the basis of 600 g/m² a curable mixture having the following by weight composition:

| | |
|---|---|
| Polyoxypropylene glycol | 100 parts |
| Fine chalk | 40 parts |
| Red iron oxide | 3 parts |
| Molecular sieve | 2 parts |
| Ethylene glycol | 3 parts |
| Tin salt | 2 parts |
| Diphenylmethane diisocyanate prepolymer with 23% of free NCO | 30 parts |

A layer of powdered solid material formed of a fine powder of polyurethane having a granulometry of 0.2 to 1 mm was spread on said layer on the basis of 200 g/m² 10 seconds after application of the curable resin.

In order to accelerate cross-linking, the mixture was put in a hot air drying oven at a temperature of 80° C. for 5 minutes.

The sheet material obtained had a thickness of about 1 mm and a weight of 850 to 900 g/m². Its elongation was 60% under a tensile force of 16N per linear cm.

EXAMPLE 2

As support layer was used a nonwoven layer formed of a mixture of polyamide and cotton fibers bonded by an acrylic resin, the support layer having a weight of 200 g/m², a thickness of 0.7 mm and an elongation at the breaking point of 60%.

One of the faces of the nonwoven layer was coated with a synthetic rubber based adhesive layer, reactivable by heat and protected by a protective paper.

On the other face was continuously deposited by spraying 400 g/m² of a curable polyurethane resin having the following composition:

| | |
|---|---|
| Diphenylmethane diisocyanate polymer with 3% of free NCO 70% solution in a mixture of aliphatic solvents | 100 parts by weight |
| Tin salt | .2 parts by weight |
| Pigments | 3 parts by weight |

On this layer were deposited after 10 seconds 200 g/m² of a polyurethane fine powder having a granulometry between 0.2 and 1 mm.

The resin was cross-linked with evaporation of the solvents by being put in an oven at 80° C. for 7 minutes.

On the upper face was then deposited by spraying a second layer of polyurethane resin on the basis of 50 g/m², said resin being of formula:

| | |
|---|---|
| Diphenylmethane diisocyanate prepolymer with 3% of free NCO in a 30% solution in aliphatic solvents | 100 parts by weight |
| Tin salt | .2 parts by weight |
| Pigment mixture | 3 parts by weight |

The sheet material was then put into a stove at 80° C. for 7 minutes in order to complete cross-linking and evaporation of the solvents.

The second polyurethane resin layer forms an anti-dirt protective film, it increases the abrasive strength and protects the fine powder which is on the surface.

I claim:

1. A conformable sheet covering with high coefficient of friction, comprising an upper layer formed of a fine powder at least partially imbedded in a curable resin layer bonded to a lower support layer, wherein the support layer is made of a thin sheet material having an elongation coefficient between 20 and 60% for a tensile force per linear centimeter less than 20N, a layer of contact adhesive on the back face of the support layer, and a pull off film protecting the adhesive layer, whereby the sheet can be stretched to conform to the contours of a three-dimensional surface and said adhesive will thereafter retain the sheet in the shape of said contours.

2. A covering according to claim 1, wherein the thin layer material is made of a plastic material film obtained by extrusion or calendering, having a thickness between 0.01 and 1 mm, preferably between 0.05 and 0.10 mm.

3. A covering according to claim 1, wherein the thin layer material is made of a conformable textile of the extensible knitted fabric type, having a thickness less than 3 mm.

4. A covering according to claim 1, wherein the thin layer material is made of needled or a chemically bonded nonwoven having a thickness less than 1 mm and an elongation before breaking between 20 and 60%.

5. A covering according to claim 1, wherein said upper layer is of cured resin, particularly a polyurethane, in which is at least partially imbedded a fine powder of a compatible material, particularly polyurethane, having a granulometry between 0.2 and 1 mm, the overall thickness of the upper layer being between 0.5 and 3 mm, said support layer being bonded to the upper layer by chemical welding during curing of the compatible materials and/or partial imbedding of the constituent fibers of said thin sheet material and the overall thickness of the covering being between 0.5 and 3 mm.

6. A covering according to claim 1, wherein a cured resin layer is applied on the upper layer in order to coat the fine powder.

* * * * *